United States Patent [19]

Donachie

[11] 3,944,442

[45] Mar. 16, 1976

[54] AIR HARDENABLE, FORMABLE STEEL

[75] Inventor: Stephen James Donachie, New Windsor, N.Y.

[73] Assignee: The International Nickel Company, Inc., New York, N.Y.

[22] Filed: July 29, 1974

[21] Appl. No.: 492,739

Related U.S. Application Data

[63] Continuation-in-part of Ser. No. 379,118, July 13, 1973, abandoned, and a continuation-in-part of Ser. No. 379,119, July 13, 1973, abandoned.

[52] U.S. Cl. ..... 148/12 F; 148/12.4

[51] Int. Cl.[2] ..... C21D 7/00; C21D 9/00

[58] Field of Search ..... 148/12 F, 12.4

[56] References Cited

UNITED STATES PATENTS

| | | | |
|---|---|---|---|
| 2,449,806 | 9/1948 | Fetzer et al. | 75/126 |
| 3,278,345 | 10/1966 | Grange et al. | 148/12 F |
| 3,619,302 | 11/1971 | Aoki et al. | 148/12 F |
| 3,732,127 | 5/1973 | Furgason | 148/12.4 |

FOREIGN PATENTS OR APPLICATIONS

| | | |
|---|---|---|
| 886,605 | 1/1962 | United Kingdom |
| 1,067,696 | 5/1967 | United Kingdom |
| 1,243,401 | 6/1967 | Germany |
| 645,451 | 5/1937 | Germany |

*Primary Examiner*—W. Stallard

*Attorney, Agent, or Firm*—Raymond J. Kenny; Ewan C. MacQueen

[57] ABSTRACT

A process for producing a highly formable steel capable of affording yield strengths upwards of 90,000 psi through air hardening and without need of liquid quenching, the steel preferably contains correlated percentages of chromium and nickel among other elements and should be in the martensitic condition prior to the first heat treating step.

9 Claims, No Drawings

AIR HARDENABLE, FORMABLE STEEL

The instant application is a continuation-in-part application of U.S. applications Ser. Nos. 379,118 and 379,119 filed July 13, 1973 both of which are now abandoned.

The subject invention concerns the metallurgy of steel, and is specifically addressed to the development of a highly formable steel capable of delivering yield strengths upwards of 90,000–120,000 psi, but which can be air hardened to that strength level without recourse to liquid quenching.

As recently reported (1), a number of low alloy high strength steels are presently available which offer attractive yield strengths, i.e., above 80,000 psi, together with a reasonable degree of toughness. Normally there are but a few strengthening mechanisms used in producing such steels, notably controlled rolling with morphological shape control (mostly sulfide), carbon strengthening with small additions of strong carbide formers, and precipitation hardening.

In the production of such steels, many require a liquid quench, whether it be off the hot mill or in combination with a temper or otherwise. In any case, it can be said that such a quench is rather the antithesis of the instant invention. For quite apart from consideration of strength, it can introduce certain hazards, including cracking, warping, distortion, etc., principally by reason of the high internal stresses set up as a consequence thereof.

But even as to those low alloy high strength steels which are not so handicapped, most are conspicuous by their lack of formability, a pronounced drawback. And this, ironically perhaps, is largely attributable to their high strength. This is not to suggest that such high strength steels are beyond being formed, say by bend forming. However, it does bring into focus as to what is meant by "formability", a term perhaps often used too loosely. As contemplated herein, formability encompasses all three principal forming modes, bending, stretching and drawing. It is not at all uncommon for a steel to be "bend" formable only to fare poorly by way of response to a stretching and/or drawing operation. Actually, many of those steels which "bend form" do so only under very high bending loads. And this, in turn, is reflected in higher power costs.

I have now found that (a) high yield strengths, as high as 90,000–120,000 psi and above, and (b) excellent formability (as above indicated) can be brought together in a single steel which is, nonetheless, (c) air hardenable; provided, however, the steel is (i) of a special composition, (ii) heat treated under certain conditions and (iii) at a certain temperature, (iv) fabricated to desired configuration in that condition, and (v) thereafter again heat treated within a temperature range further herein described. Furthermore, the steel is weldable and capable of absorbing a satisfactory level of impact energy.

Generally speaking, the present invention contemplates the production of fabricated steel components or structures through the application of a series of operations which comprise (i) providing a steel of correlated composition, the steel containing up to 0.2% carbon or possibly up to 0.3% thereof where otherwise less resistance to impact can be tolerated, up to 6% chromium, up to about 4% manganese, up to about 3% nickel, up to 4% molybdenum, up to about 1.25% copper, up to 1% aluminum, up to 1% silicon and the balance essentially iron, the constituents being interrelated to satisfy the following Base Factor (BF) relationship $$5 \times \%C, + \%Mn, + \%Cr, + \tfrac{2}{3} \times \%Ni, + \%Mo, + \tfrac{2}{3} \times \%Cu, + \tfrac{1}{2} \times \%Al, + \tfrac{1}{4} \times \%Si \geq 5.5;$$

(ii) heating the steel above its recrystallization temperature but below its $A_1$ temperature for a period such that hardness is substantially reduced and significant softness is induced; (iii) cooling the steel to a temperature desired for forming (normally room temperature and up to 200°F.); (iv) subjecting the steel to a forming operation to attain the configuration desired; (v) heating the formed component at a temperature above the $A_3$ of the steel composition to form a substantially austenitic structure, most advantageously within the temperature range of 1550°–1750°F.; and (vi) thereafter cooling the formed component. the microstructure of the steel being substantially that in the hot rolled condition.

In accordance herewith, the invention enables steels of low to moderate cost to be utilized which steels can then be formed at low yield strength plateaus, e.g., 40,000–60,000 psi using low load forces (and thus minimum power) with excellent response being achieved in respect of each of the three primary forming modes. Because of the ultimate high strengths attainable, components and structures of thinner sections can be employed than otherwise might be the case, this at a not insignificant cost benefit. This coupled with the substantial weight reduction made possible, affords a product designed to more effectively counter the inroads of competitive materials. It is envisaged, for example, that the subject steel can be used for fabricating automotive bumpers, an application for which lightweight aluminum and plastics are aggressively vying. (2) Too, since the present steel is so highly formable, approaching even that of AISI 1008, the scope of structural shapes and sizes obtainable is markedly extended.

In carrying the invention into practice, it is deemed of particular benefit that the steel be in the martensitic condition prior to being heated between its recrystallization and $A_1$ temperature. This largely contributes to achieving the desired high strength levels. By observing the abovdescribed Base Factor alloying relationship a martensitic structure is virtually assured. It should be pointed out that a martensitic structure as contemplated herein includes any of the products of shear transformation of an essentially face-centered-cubic iron to an essentially body-centered-cubic iron.

The Base Factor can be lowered to about 5 or even down to about 3.5 or 4; however, this will be at the expense of strength and will likely require thicker sectioned materials, depending upon a given application. Unnecessary second phases may also be present. It is deemed advantageous that the steel contain from about 2 to 4%, particularly from 2.5 to 3.5%, chromium; about 1.25 to 3%, and preferably from 1.5 to 2.5%, nickel; from 0.005 to 0.15%, e.g., 0.01 to 0.1% carbon; up to 0.5% molybdenum; up to about 1 or 1.25% copper; up to 0.5 or 1% silicon; up to 0.1 or 0.2% aluminum, balance essentially iron. Another steel of desired composition contains about 1.5% to 3.5%, preferably about 1.75% to 3.25% manganese, in lieu of the nickel content.

While the presence of such elements as columbium, vanadium, titanium, tantalum and boron can be tolerated in small amounts, they should be limited to low levels, say, less than about 0.05% of each, since they can impair formability. Normal percentages of sulfur, phosphorus, nitrogen, oxygen, etc., consistent with good steel-making practice, are permissible.

Following conventional steel practice, the contemplated steel will usually be treated in the as hot-rolled condition, i.e., the condition obtained upon air cooling off the hot mill. Because of the nature of the martensitic (shear) transformation these structures, after hot working, contain relatively high amounts of residual strain. And there is, in accordance herewith, considerable advantage to be gained with a structure containing strain. For example, a larger gap is created between the recrystallization and $A_1$ temperatures. This in turn, facilitates fabrication by enabling the steel to be softened more readily to its most formable condition. Put another way, strain generally results in a lower recrystallization temperature. This means that heating to obtain formability can be conducted at a temperature producing relatively maximum softness or it can be performed at a lower temperature with the equivalent degree of softness as would be obtained at a higher temperature in the absence of strain.

Additional (as distinct from residual) strain can be imparted to the steel in a number of ways. For example, hot rolling can be controlled so that the finishing temperature is on the order of 1500°F., say 1450°–1600°F. This controlled rolling produces strain. Or the steel can be slow cooled from hot rolling (actually air cooling could be used) and thereupon cold rolled. This confers strain upon the martensite. Furthermore, cold rolling prior to the first heat treatment (between recrystallization and $A_1$) results in a texture being developed in the steel which enhances drawability, it being considered that a high plastic anisotropy ratio (high R value) obtains. Usually it also desirably reduces yield strength.

In terms of heat treatment, should the $A_1$ temperature be violated on the upside, fresh martensite can be formed. This results in higher hardness and thus detracts from formability. Thus, while a temperature above $A_1$ can probably be used, say 25°–50°F. above, it is unnecessary to do so to obtain desired softening. It is to advantage that the first heating be within about 50°F. of the $A_1$ temperature. Of course, $A_1$ (as does $A_3$) depends upon composition and is easily determined as is well known to those skilled in the art. Generally, a temperature of 1150°–1400°F. will be satisfactory for the first step, the steel being held thereat for about 1 to 48 hours, the shorter time being used at the higher temperature. It is preferred that a temperature of 1200° or 1250°F. to 1300° or 1350°F. be used over a duration of about 24 to 48 hours. The idea is to so heat steel such that a yield strength of less than 70,000 to 60,000 psi is obtained.

With regard to the second stage heating, it should be conducted at a temperature and for a period to bring about a transformation to austenite or substantially austenite. Upon cooling strength is restored, the steel undergoing transformation to the structure present in the hot rolled condition. A temperature of from 1500°–2000°F. is generally suitable, the holding time being, say, for at least about 5 minutes. It is preferred to use a temperature range of 1500 to 1650°F. for a period upwards of about 10 minutes, say to 30 minutes. The steels, depending upon chemistry, will manifest yield strengths of about 90,000 and upwards of about 120,000 psi.

The following description and data are given as illustrative of what can be accomplished in accordance with the invention.

A number of alloy steels, compositions set forth in Table I, were prepared as follows: using raw materials of relative commercial purity, e.g., spectographic carbon, low carbon ferromanganese and ferrosilicon, ferrochromium, etc., a charge of chromium and nickel (and molybdenum when used) was placed in an air induction furnace, brought to heat at about 3000°F. and cooled to about 2900°F., whereupon silicon and manganese were added to deoxidize the melt. Carbon was added for a carbon boil and silicon and manganese were added if necessary. After skimming the melt, ferromanganese and ferrosilicon were added. Aluminum was again added for deoxidation. Titanium was then introduced in a few heats as was aluminum in one instance as a purposeful alloying addition.

The melts were poured at 2850°–2900°F., cooled, with the ingots being thereafter soaked at approximately 2000°F. The ingots were then hot worked to sizes of ⅛ to ½ inch thick. A controlled finishing temperature of about 1500°F. was used for Alloys 2 and 3, a 50% reduction in thickness being accomplished. Various alloys were cold rolled. The processed condition is given in Table II, together with mechanical properties at various stages of treatment. Alloys 1–7 are within the most advantageous alloying ranges of the invention, whereas Alloys 8–10 are of lower strength.

TABLE I

| Alloy No. | C % | Mn % | Si % | Ni % | Cr % | Mo % | Ti % | Al % | Fe % |
|---|---|---|---|---|---|---|---|---|---|
| 1 | 0.06 | 0.25 | 0.46 | 1.76 | 3.9 | n.a. | 0.03 | — | bal. |
| 2 | 0.06 | 0.23 | 0.44 | 1.97 | 3.8 | 0.42 | 0.005 | — | bal. |
| 3 | 0.066 | 0.55 | 0.17 | 1.69 | 4.2 | n.a. | — | 0.09 | bal. |
| 4 | 0.035 | 3.05 | 0.19 | — | 3.07 | n.a. | n.a. | 0.11 | bal. |
| 5 | 0.092 | 2.35 | 0.19 | — | 3.0 | n.a. | n.a. | 0.11 | bal. |
| 6 | 0.058 | 2.18 | 0.21 | — | 3.75 | n.a. | n.a. | 0.09 | bal. |
| 7 | 0.056 | 2.32 | 0.20 | — | 3.07 | n.a. | n.a. | 0.11 | bal. |
| 8 | 0.059 | 0.24 | 0.45 | 2.02 | 2.1 | n.a. | 0.026 | — | bal. |
| 9 | 0.062 | 1.63 | 0.19 | 0.76 | .50 | 0.2 | n.a. | 0.12 | bal. |
| 10 | 0.060 | 1.11 | 0.78 | — | 3.0 | n.a. | 0.18 | 0.11 | bal. |

bal. = balance plus impurities

TABLE II

| Alloy No. | Processed Condition | YS (ksi) | UTS (ksi) | % El. | % R.A. | CVN* (ft.lbs) |
|---|---|---|---|---|---|---|
| 1 | a. Hot Rolled + 48 hr/1250°F/AC | 62.0 | 71.4 | 34 | | |
| | b. Hot Rolled + 48 hr/1300°F/AC | 42.3 | 68.8 | 27 | | |
| | c. Hot Rolled + 1/2 hr/1600°F/AC | 115.2 | 162.2 | 13 | | |
| 2 | a. Hot Rolled + 48 hr/1250°F/AC | 43.4 | 70.2 | 30 | | |
| | b. Hot Rolled + 48 hr/1300°F/AC | 43.8 | 69.7 | 32 | | |

TABLE II-continued

| Alloy No. | Processed Condition | YS (ksi) | UTS (ksi) | % El. | % R.A. | CVN* (ft.lbs) |
|---|---|---|---|---|---|---|
| | c. Hot Rolled + 1/2 hr/1600°F/AC | 119.5 | 164.4 | 14 | | |
| 3 | a. Hot Rolled/AC + 48 hr/1275°F/AC | 54 | 76.3 | 36.5 | 78 | |
| | b. Hot Rolled/AC + 48 hr/1275°F/AC + 1/2 hr/1450°F/AC | 106.6 | 151.1 | 16.5 | 64.5 | 25.5 |
| 4 | a. Hot Rolled/AC | 101.0 | 148.3 | 18 | 73.5 | — |
| | b. Hot Rolled/AC + 45 hr/1250°F/AC | 52.0 | 90.1 | 29 | 75 | |
| | c. Hot Rolled/AC + Cold rolled + 45 hr/1250°F/AC | 39.9 | 80.3 | 32.5 | 70.5 | — |
| | d. Hot Rolled/AC + 45 hr/1250°F/AC + 1/2 hr/1700°F/AC | 107.5 | 144.1 | 18 | 68 | 22.5 |
| | e. Hot Rolled/AC + 5 hr/1325°F/AC | 74.8 | 115.9 | — | 72.5 | |
| 5 | a. Hot Rolled/AC | 119.7 | 179.6 | 16.5 | 64.5 | — |
| | b. Hot Rolled/AC + 45 hr/1250°F/AC | 53.1 | 81.5 | 32.5 | 76 | — |
| | c. Hot Rolled/AC + Cold rolled + 45 hr/1250°F/AC | 39.4 | 73.5 | 36.5 | 73 | — |
| | d. Hot Rolled/AC + 45 hr/1250°F/AC + 1/2 hr/1700°F/AC | 124.3 | 184.5 | 18 | 59 | 33.5 |
| 6 | a. Hot Rolled/AC | | | | | |
| | b. Hot Rolled/AC + 48 hr/1275°F/AC | 47.7 | 73.2 | 36.5 | 76.5 | |
| | c. Hot Rolled/AC + 48 hr/1275°F/AC + 1/2 hr/1650°F/AC | 112.1 | 161.1 | 16.5 | 56.5 | 23 |
| 7 | a. Hot Rolled/AC | 107.7 | 148.3 | 18 | 73.5 | |
| | b. Hot Rolled/AC + 45 hr/1250°F/AC | 49.5 | 75.1 | 34.5 | 78 | |
| | c. Hot Rolled/AC + Cold rolled + 45 hr/1250°F/AC | 39.3 | 68 | 36.5 | 73 | |
| | d. Hot Rolled/AC + 45 hr/1250°F/AC + 1/2 hr/1750°F/AC | 109.0 | 162.6 | 165 | 63.5 | 41.5 |
| 8 | a. Hot Rolled/AC | | | | | |
| | b. Hot Rolled/AC + 48 hr/1250°F/AC | 62.3 | 74.7 | 29 | | |
| | c. Hot Rolled/AC + 48 hr/1300°F/AC | 60.9 | 69.7 | 31 | | |
| | d. Hot Rolled/AC + 1/2 hr/1600°F/AC | 54.4 | 101.3 | 24 | | |
| 9 | a. Hot Rolled/AC + 45 hr/1250°F/AC | 48.4 | 63.3 | 38 | 78.5 | |
| | b. Hot Rolled/AC + 45 hr/1250°F/AC + 1/2 hr/1700°F/AC | 41.4 | 81.0 | 32.5 | 68 | |
| 10 | a. Hot Rolled/AC + 45 hr/1250°F/AC | 59.7 | 87.9 | 29 | 76 | |
| | b. Hot Rolled/AC + 45 hr/1250°F/AC + 1/2 hr/1700°F/AC | 44.6 | 85.1 | 31 | 69.5 | |

*Room Temp.; AC = Air Cool;

With regard to the above data, the criteria used to delineate acceptable formability included a tensile elongation (in 2 inches) of at least 25% (the indicia for stretch forming) and a Reduction of Area of at least 60% (bend forming). Concerning Alloy 1 it will be noted that it had a yield strength of about 115 ksi in the normalized condition (virtually equivalent to hot rolled strength level). This would be astronomically high for ease of formability. Upon being treated between its recrystallization and $A_1$ temperatures, i.e., 1250°F., the yield strength was markedly reduced, tensile elongation being raised to over 30%. These conditions are excellent for fabricating. Similar comments apply to Alloys 2–7.

Alloys 8–10 were of lower alloy content, the Base Factor (BF) being well less than 5. Yield strength was low irrespective of the condition of treatment.

An Olsen cup test was also employed in respect of Alloys land 6 in which specimens were hot rolled at 2000°F. to ⅛ inch plate, heated for 30 minutes at 1650°F., air cooled, cold rolled to 0.050 inch sheet, heated at 1250°F. for 48 hours and air cooled. The average Olsen cup height was 0.438 inch and 0.408 inch (average of 3), respectively. This compares quite favorably with AISI 1008.

The subject invention is deemed useful in the production of a wide range of materials. In this sense the steel contemplated can be considered suitable for "structural" applications. In the automotive area, and bumpers aside, stampings for certain body panels might be mentioned as well as oil pans, wheels, etc. Since the instant steel is amenable to welding, formed and welded structures such as bumper supports, box frame members, and high strength welded tubing can be produced in accordance herewith.

The term "balance" and "balance essentially" as used herein in referring to the iron content is not intended, as will be understood by those skilled in the art, to exclude the presence of other elements commonly present as incidental constituents, e.g., deoxidizing and cleansing elements, and impurities normally associated therewith in small amounts which do not adversely affect the basic characteristic of the steel. Particularly if cold rolling is employed, elements such as columbium, vanadium, titanium, tantalum and boron can be tolerated at levels above 0.05% and up to at least 0.15 or 0.2%. These elements tend to inhibit recrystallization and it is considered that cold working overcomes this effect.

Although the invention has been described in connection with preferred embodiments, modifications may be resorted to without departing from the spirit of the invention. Quite obviously, for example, all that has been said herein concerns non-liquid quenched steels. Liquid quenching can be employed but is not necessary. It is within the overall scope of the invention. Such are considered within the purview of the invention and appended claims. (1) Materials Engineering, September 1972, p. 21. (2) Business Week, June 2, 1973, pp. 56c, e, h and k.

I claim:

1. A process for producing a steel adapted for structural applications which comprises:

i. providing a steel of correlated composition and of a martensitic structure, the steel containing up to about 0.2% carbon, up to about 4% manganese, up to about 3% nickel, up to about 6% chromium, up to about 4% molybdenum, up to about 1.25% copper, up to about 1% aluminum, up to about 1% silicon, and the balance essentially iron, the constituents being interrelated to satisfy the following Base Factor (BF) relationship:

$$5 \times \%C, + \%Mn, + \%Cr, + \tfrac{3}{5} \times \%Ni, + \%Mo; + \tfrac{2}{3}\ \%Cu, + \tfrac{1}{2}\ \%Al, + \tfrac{1}{4}\ \%Si \geq 5;$$

ii. heating the steel above its recrystallization temperature but below its $A_1$ temperature;

iii. cooling the steel to a temperature desired for forming;

iv. subjecting the steel to a forming operation to attain the configuration desired;

v. heating the formed structure at a temperature above the $A_3$ temperature of the steel; and vi. thereafter cooling the structure formed.

2. A process in accordance with claim 1 in which the steel has been cold rolled prior to step (ii).

3. A process in accordance with claim 1 in which step (i) is carried out within the temperature range of about 1150°F. to 1400°F. for a period of about 1 to 48 hours.

4. A process in accordance with claim 3 in which the operating condition is about 1200° to 1350°F. for 24 to 48 hours.

5. A process in accordance with claim 1 in which step (v) is carried out at 1500° to 2000°F. for at least about 5 minutes.

6. A process in accordance with claim 5 in which a temperature 1550° to 1750°F. is used for at least about 10 minutes.

7. A process in accordance with claim 1 in which the alloy contains about 2 to about 4% chromium, about 1.25 to 3% nickel, about 0.005 to 0.15% carbon, up to about 0.5% molybdenum, up to about 1.25% copper and up to about 1% silicon.

8. A process for producing a steel adapted for structural application which comprises:

i. providing a steel of correlated composition and of a martensitic structure, the steel containing up to about 0.2% carbon, up to about 4% manganese, up to about 3% nickel, up to about 6% chromium, up to about 4% molybdenum, up to about 1.25% copper, up to about 1% aluminum, up to about 1% silicon, and the balance essentially iron, the constituents being interrelated to satisfy the following Base Factor (BF) relationship:

$$5 \times \%C, + \%Mn, + Cr, + \tfrac{2}{3} \times \%Ni, + \%Mo, + \tfrac{2}{3}\ \%Cu, + \tfrac{1}{2}\ \%Al, + \tfrac{1}{4}\ \%Si \geqslant 3.5$$

ii. heating the steel above its recrystallization temperature but below its $A_1$ temperature;

iii. cooling the steel to a temperature desired for forming;

iv. subjecting the steel to a forming operation to attain the configuration desired;

v. heating the formed structure at a temperature above the $A_3$ temperature of the steel; and vi. thereafter cooling the structure formed.

9. A process in accordance with claim 8 in which BF is at least 4.

* * * * *